United States Patent [19]

Szucs

[11] Patent Number: 4,815,249

[45] Date of Patent: Mar. 28, 1989

[54] SCAFFOLDING AND BRACES FOR USE IN SCAFFOLDING

[75] Inventor: Andras Szucs, Birmingham, United Kingdom

[73] Assignee: Ibex Scaffolding Limited, Midlands, United Kingdom

[21] Appl. No.: 756,515

[22] PCT Filed: Oct. 30, 1984

[86] PCT No.: PCT/GB84/00365

§ 371 Date: Jul. 1, 1985

§ 102(e) Date: Jul. 1, 1985

[87] PCT Pub. No.: WO85/01975

PCT Pub. Date: May 9, 1985

[30] Foreign Application Priority Data

Nov. 5, 1983 [GB] United Kingdom ..... 8329597
Sep. 25, 1984 [GB] United Kingdom ..... 8424216

[51] Int. Cl.[4] ..... E04G 7/30

[52] U.S. Cl. ..... 52/638; 52/655; 403/49

[58] Field of Search ..... 52/638, 637, 655, 645, 52/646; 403/49; 182/179

[56] References Cited

U.S. PATENT DOCUMENTS

| | | | |
|---|---|---|---|
| 877,624 | 1/1908 | Yorke | 52/638 |
| 1,645,980 | 10/1927 | Bearly | 52/638 |
| 4,095,910 | 6/1978 | Steele et al. | 52/638 |
| 4,445,307 | 5/1984 | Puccinelli et al. | 52/638 |

FOREIGN PATENT DOCUMENTS

| | | | |
|---|---|---|---|
| 76774 | 4/1983 | European Pat. Off. . | |
| 2096226 | 2/1972 | France . | |
| 2517351 | 6/1983 | France . | |
| 83528 | 8/1954 | Norway | 52/648 |
| 293639 | 10/1953 | Switzerland | 52/648 |
| 737530 | 9/1955 | United Kingdom | 52/648 |
| 1314571 | 4/1973 | United Kingdom . | |
| 1570383 | 7/1980 | United Kingdom . | |
| 1599646 | 10/1981 | United Kingdom . | |
| 2149046A | 6/1985 | United Kingdom | 403/49 |

*Primary Examiner*—David A. Scherbel
*Assistant Examiner*—Caroline D. Dennison
*Attorney, Agent, or Firm*—Marshall, O'Toole, Gerstein, Murray & Bicknell

[57] ABSTRACT

A scaffolding comprises uprights (6), cross members (8) with connection members (12) by which the cross members may be connected to the upright members, and diagonal braces (10) with mounting formations (42) adapted to be interfitted with receiving formations (32, 34) of the connection members (12). The mounting formation (42) is generally cylindrical, and its longitudinal axis intersects the longitudinal axis of the brace substantially at right angles, generally centrally of the mounting formation. The mounting formation is carried by a cranked connection portion (44). The receiving formations (32, 34) are provided by transverse bores (36), with lateral recesses in which the connection portions (44) are located when the mounting formations (42) are positioned in the bores (36). This allows forces to be transmitted between the connection member (12) and the diagonal brace substantially on the longitudinal axis of the brace, over a range of angular articulation of the brace relative to the cross member.

16 Claims, 6 Drawing Sheets

FIG 4
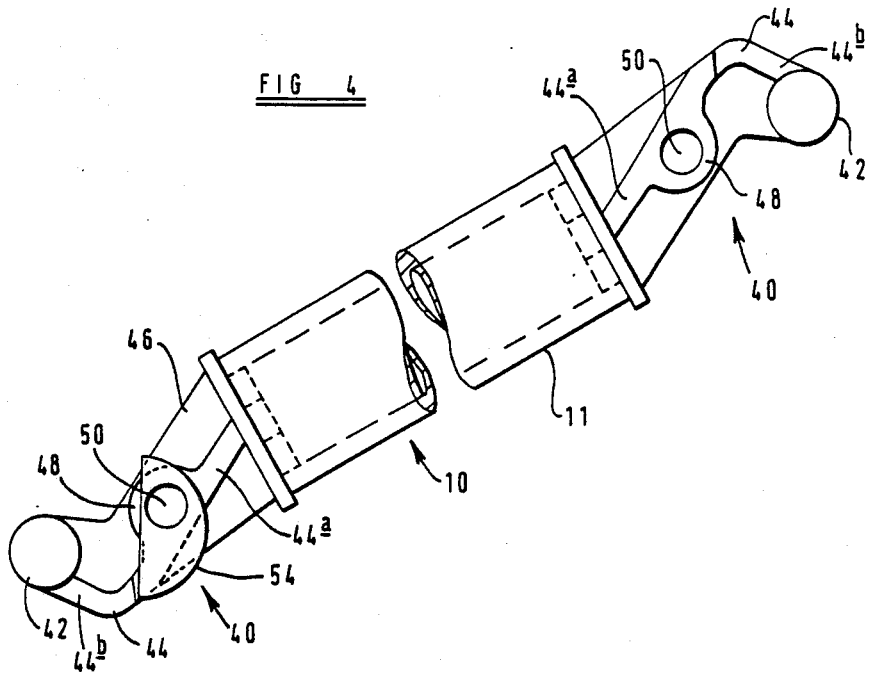
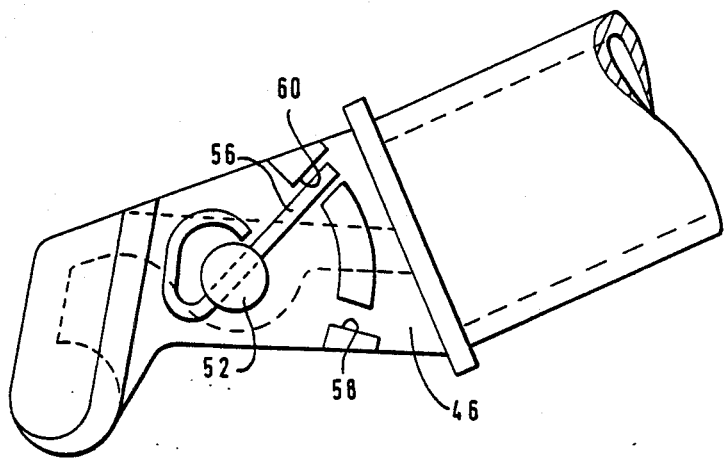
FIG 5

SCAFFOLDING AND BRACES FOR USE IN SCAFFOLDING

BACKGROUND OF THE INVENTION

1. Field of Invention

This invention is concerned with improvements relating scaffolding of the kind (hereinafter referred to as being of the kind specified) comprising elongate upright members (which usually extend vertically), elongate cross members (which usually extend horizontally) provided with connection members by which the cross members may be connected to the upright members, and diagonal members of braces comprising mounting formations adapted to be interfitted with receiving formations of the connection members. The invention is particularly concerned with scaffolding which is intended for use as shoring (for example) to support shuttering for use in forming concrete floors and the like. In such application, adjustable jacks are provided at the base of the upright members where the supporting ground is not level and/or uneven. Alternatively, or in addition, adjustable jacks are provided at the upper ends of the upright members, the jacks carrying supporting heads which engage the elements to be supported and thus permit the elements to be supported in a predetermined orientation, for example in a horizontal plane, irrespective of variation in the level of the surface upon which the scaffolding is erected.

2. Description of the Relate Art

Examples of scaffolding of this kind are shown in U.K. Patent Specification No. 1,599,646.

The effectiveness of a scaffolding is measured by its load carrying capacity, and the allowable load of a scaffolding is defined as a fraction of its failure load.

In use, scaffolding of the kind specified is subjected to both vertical and horizontal forces. The vertical forces are carried by the upright members, and failure of the upright members, when overloaded, is by buckling.

Additionally, vertical forces may be transmitted between the upright members by the diagonal braces.

Horizontal forces acting on the top of the structure are also transmitted to the upright members by the braces, being resolved into upward and downward components. Thus, not only must the braces be capable of withstanding buckling under compressive load, but they must also be capable of withstanding tension forces.

The buckling values of the elongate structural members are governed by their effective lengths, and can be reduced by the use of stiff, moment-transmitting joints between the members.

SUMMARY OF THE INVENTION

According to this invention, there is provided a scaffolding comprising upright members, cross members, brace members and connection members by which some at least of the members may be connected together, the braces comprising mounting formations adapted to be interfitted with receiving formations on the connection members, wherein the mounting formations and the receiving formations provide abutting surface portions through which forces are transmitted between the connection member and the brace, through which abutting surface portions the longitudinal axis of the brace extends.

In this manner, location of the longitudinal axes of the upright cross and brace members in a vertical plane is facilitated, and the tendency for compression forces acting on the brace to cause buckling of the brace is significantly reduced.

Preferably, abutting surface portions are provided which transmit forces in both longitudinal directions. Thus, tension forces acting on the brace will be distributed more uniformly over the brace, and tendency for failure of the brace to occur through localised fatigue may be significantly reduced.

Preferably, said abutting surface portions are circular whereby longitudinal forces may be transmitted between the connection member and the brace in a range of angular positions of the brace in relation to the connection member.

Preferably, the abutting surface portions of the brace are provided by a part-cylindrical surface of the mounting formation.

Advantageously the axis of said part-cylindrical surface lies in a plane which extends at right angles to a plane containing the longitudinal axis of the brace, and preferably the two axes intersect within the mounting member.

According to this invention, there is also provided a brace for a scaffolding comprising upright members, cross members and connection members by which some at least of the members may be connected together, the brace comprising an elongate member to which a mounting formation is connected by a connection portion in a manner such as to provide curved surface portions of the mounting formation which lie on opposite sides of the connection member and through which the longitudinal axis of the elongate member extends, and which are free for abutting engagement with surface portions of the connection member.

According to this invention, there is also provided a scaffolding comprising upright members, cross members and connection members by which the cross members may be connected to the upright members, and diagonal members or braces comprising mounting formations adapted to be interfitted with receiving formations on the connection members, the brace comprising an elongate cylindrical member, and a generally cylindrical mounting formation, a connection portion extending between the end of the elongate member and the supporting member, wherein the mounting formation lies substantially within a cylindrical envelope coextensive with the exterior surface of the elongate member and has a longitudinal axis which intersects with the longitudinal axis of the elongate member substantially at right angles thereto.

Preferably, the connection portion extends from the end of the elongate member generally on a diametral line thereof but inclined to the longitudinal axis of the elongate member, and comprises an outer surface which extends generally tangentially to the mounting formation.

Advantageously, the connection portion is cranked at a central section, thus comprising a part (adjacent to the elongate member) which extends away from the longitudinal axis thereof, and a part (adjacent the mounting formation) which extends towards the longitudinal axis of the elongate member.

Advantageously, the depth of the connection portion is substantially equal to the axial dimension of the mounting formation, and the elongate member, the connection formation and the mounting formation are symmetrical about a plane containing the longitudinal axis of the elongate member. Preferably a reinforcing web is provided which lies in a plane at right angles to the longitudinal axis of the mounting formation and generally parallel to the longitudinal axis of the elongate member, said reinforcing web being connencted to the elongate member, the connection portion and the mounting formation.

An advantageous form of stiff, moment-transmitting connection means is described in U.K. Patent Specification No. 1,570,383 and comprises a connection member provided at each end of the cross members, comprising two, spaced limbs adapted to embrace a supporting formation on the upright member, openings being provided in the limbs and the supporting formation through which a wedge may be inserted. However, difficulty is encountered in the use of such a connection means in preventing undesired movement of the wedge from an inoperative position in which the connection member may be passed over the supporting formation.

Thus, according to this invention, there is also provided a scaffolding of the kind comprising upright members and cross members provided with connection means by which the cross members may be connected to the upright members, the connection means comprising two spaced limbs on the cross member adapted to embrace a supporting formation on the upright member, openings being provided in the limbs and in the supporting formation through which a wedge may be inserted, a lower portion of the wedge being provided with a projection and the sizes of the openings being such that said lower portion may be passed through the lower limb, the supporting formation but not the upper limb, the wedge also being provided at said lower end with a formation which may be engaged with part of the upper limb to restrain movement of the wedge from an inoperative position.

BRIEF DESCRIPTION OF THE DRAWINGS

There will now be given a detailed description, to be read with reference to the accompanying drawings, of a scaffolding which is the preferred embodiment of this invention, and which has been selected for the purposes of illustrating the invention by way of example. In the accompanying drawings:

FIG. 4 is a side elevation of the brace member according to the invention.

FIG. 5 is an enlarged view of an end portion of the brace member shown in FIG. 4, viewed from the opposite side thereof;

DETAILED DESCRIPTION OF THE PREFERRED EMBODIMENTS

The scaffolding which is the preferred embodiment of this invention comprises a plurality of upright members 6 and a plurality of horizontal or cross members 8, connection means being provided by which the upright and horizontal members may be connected together in a generally rectangular, multi-storey array, and diagonal or brace members 10 extending between the connections of some at least of the upright and horizontal members.

In the preferred embodiment, the upright, horizontal and brace members comprise elongate portions 7, 9 and 11 respectively, conveniently, but not necessarily, generally tubular.

Figure 1:
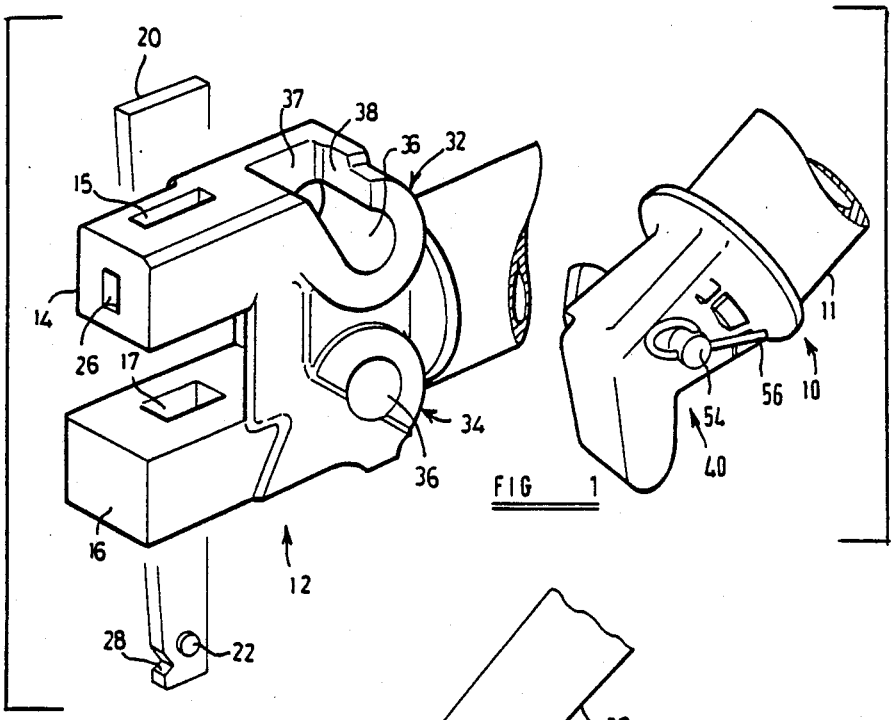
FIG. 1 is a perspective view showing part of a cross member of the preferred embodiment, together with a connection member thereof, and a brace member together with a mounting formation thereof.
Figure 2:
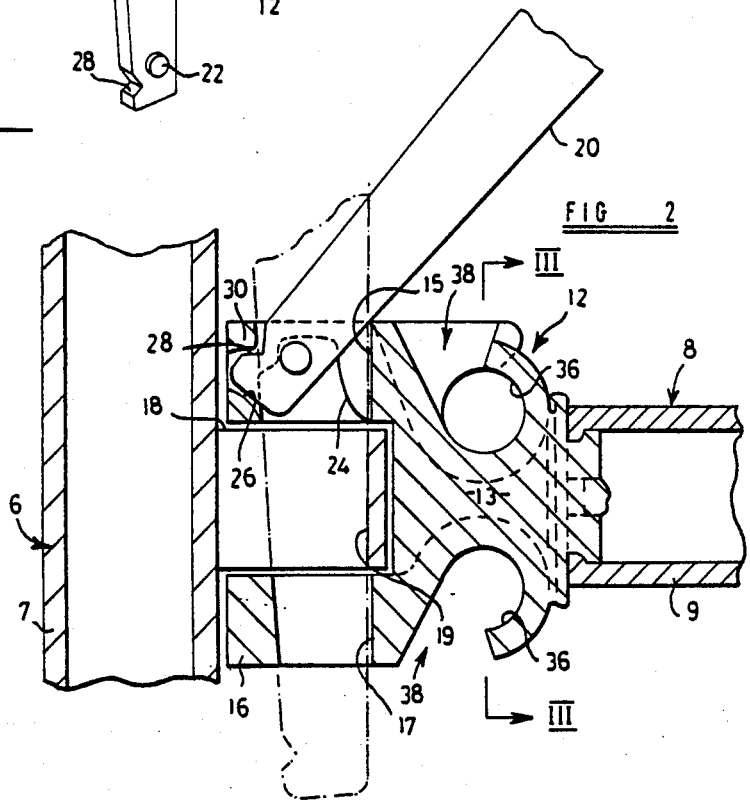
FIG. 2 is a vertical sectional view showing the connection means between the cross member and an upright member.
Figure 3:
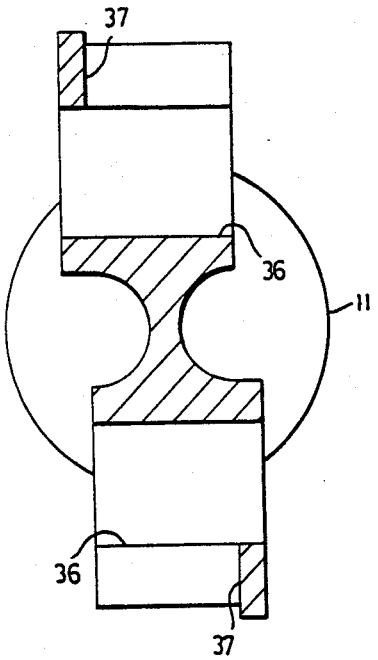
FIG. 3 is a sectional view taken on the line 3—3 of FIG. 2.

The connection means by which the cross members are connected to the upright members comprises a connection member 12 provided at each end of the horizontal members, each connection member comprising a central portion 13 which is welded to the end of the elongate member, and from which spaced limbs 14 and 16 project, the limbs being provided with through openings 15, 17 (see FIG. 2).

The connection means also comprises a supporting formation 18 welded to the upright, each upright comprising a number of supporting formations welded thereto at longitudinally-spaced intervals, the supporting portions being provided in clusters at equal longitudinal positions, spaced circumferentially round the upright member.

As with the limbs of the connection member, each supporting formation is provided with a through opening 19.

In the connection of a cross member to a horizontal member, the limbs 14 and 16 are passed over a supporting formation 18 (as shown in FIG. 2) and a securing member in the form of a wedge 20 is inserted downwardly through the openings 15, 17 and 19. The openings 17 and 19 are wider (in the dimension at right angles to the plane of the Figure) than the opening 15, and the wedge 20 is provided on its lower portion with a projection 22, the width of this being such that it can be drawn through the openings 17 and 19 but not through the opening 15.

However, the opening 15 is provided with a recess 24 in its side face to enable passage of the projection 22 beyond the lower face of the limb 14, and a further opening 26 extending from the opening 15 through a forward face of the limb, to permit angulation of the brace into the position shown in FIG. 2, in which a notch 28 in the lower portion of the wedge engages an interior corner 30 of the limb. Thus, the angulation of the wedge which is permitted by the opening 26 permits the lower end of the wecge to be moved to a position in which it does not project beyond the lower face of the limb, and simultaneously maintains the wedge in its inoperative position, minimising tendency for the wedge to be inadvertently knocked into a position in which it falls towards its operative position.

The connection member 12 comprises two receiving formations 32, 34 which are located in skew symmetry with respect to the longitudinal axis of the cross member. Each receiving formation comprises a bore 36 extending through the central portion 13, the axes of the two bores being parallel one either side of the longitudinal axis of the cross member, and recesses 38 extend through the upper and lower faces of the central portion, opening into the bores, said recesses being outwardly tapered, as is shown in relation to the upper of the two recesses which are shown in FIG. 2.

Thus, each receiving formation comprises a generally cylindrical bearing surface which subtends an angle of approximately 270°.

Each brace 10 comprises at each end portion thereof a mounting device 40 comprising a generally cylindrical mounting formation 42 and a connection portion 44 extending between the end of the elongate member 11 and the mounting formation. The depth of the connection portion 44 is substantially equal to the axial dimension of the mounting formation 42, and the mounting formation lies substantially within a cylindrical envelope coextensive with the exterior surface of the elongate member, having a longitduinal axis which intersects the longitudinal axis of the elongate member substantially at right angles.

The connection portion 44 extends from the end of the elongate member generally on a diametral line, but inclined to the longitudinal axis of the elongate member, and comprises an outer surface which extends generally tangentially to the mounting formation 42. The connection portion is cranked at a central section, and thus comprises a part 44a which extends away from the the longitudinal axis of the elongate member, and a part 44b which extends towards the longitudinal axis of the elongate member.

Additionally, the brace comprises a reinforcing web 46 welded to the elongate member 11, the connection member 44 and to one end of the mounting formation 42.

As is seen in FIG. 4, whilst the mounting formation at the opposite ends of the brace are symmetrical, the connection portions 44 and reinforcing webs 46 are in skew symmetry.

Extending through a thickened portion 48 of the conection portion 44, generally parallel to the longitudinal axis of the mounting formation, is a bore 50 in which a pin 52 of a locking device extends, the bore also extending through the web 46. On the side of the connection portion opposite to the web 46, a locking plate 54 extends from the pin 52, whilst on the opposite end of the pin a spring clip 56 is provided which may be located in either of two recesses 58, 60 provided in the underside of the web.

Figure 6:
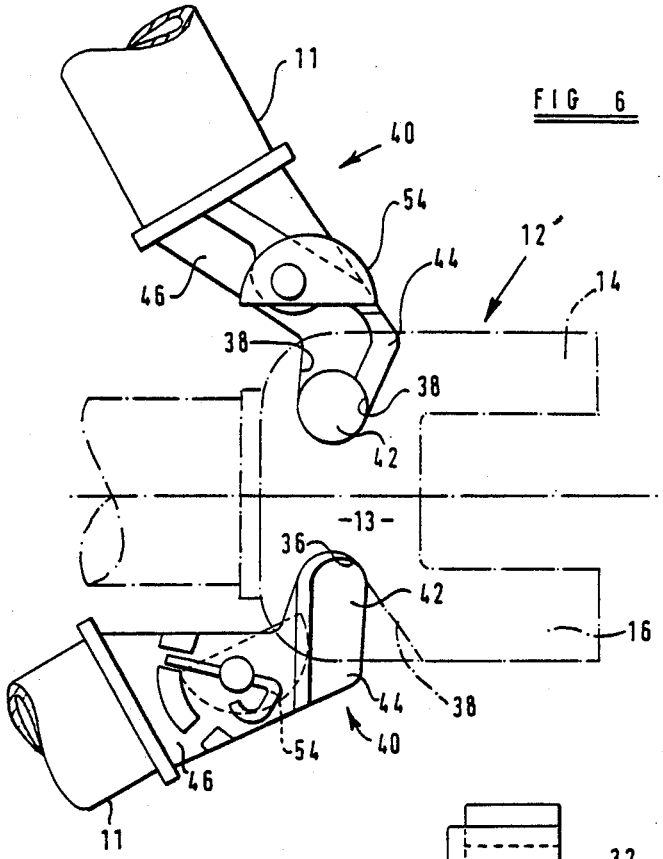
FIG. 6 is a side view showing two brace ends when positioned relative to the cross member to which they are connected.

As can be seen in FIG. 6, when the locking device is in an inoperative position (as shown at the top of FIG. 6) the mounting formation 42 may be located in the receiving formation by insertion generally in the direction of the axis of the receiving formation, such insertion being limited by engagement of the web 46 with a face 37 of the central portion through which a bore 36 extends. On removal of the clip 56 from the recess 58, and rotation of the pin 52 to allow location of the clip in the recess 60, the locking device may be moved to its operative position (shown in the lower part of FIG. 6) in which withdrawal of the mounting formation from the receiving formation is prevented.

The 90° opening provided in the bore 36 by the recess 38 (through which opening the connection portion 44 extends) permits articulation of the brace through about 40°.

In both extreme positions of articulation of the brace, the receiving and mounting formations provide generally cylindrical abutting surfaces, on both sides of the longitudinal axes thereof, to transmit both compressive and tension forces acting along the longitudinal axis of the brace to the connection member.

Figure 8:
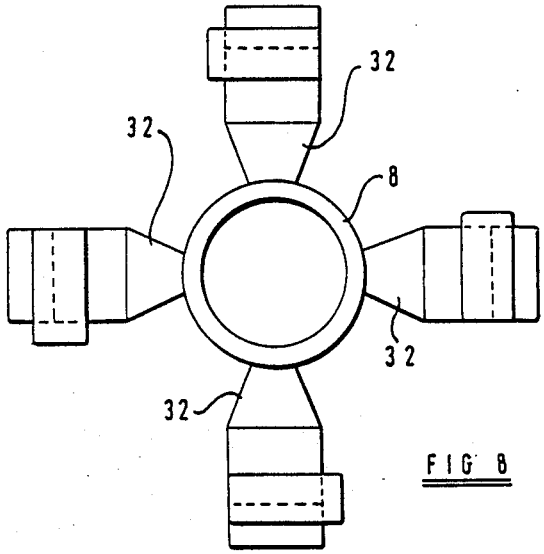
FIG. 8 is a view of the fork head connection shown in FIG. 7, as viewed with the direction of the arrow A.
Figure 7:
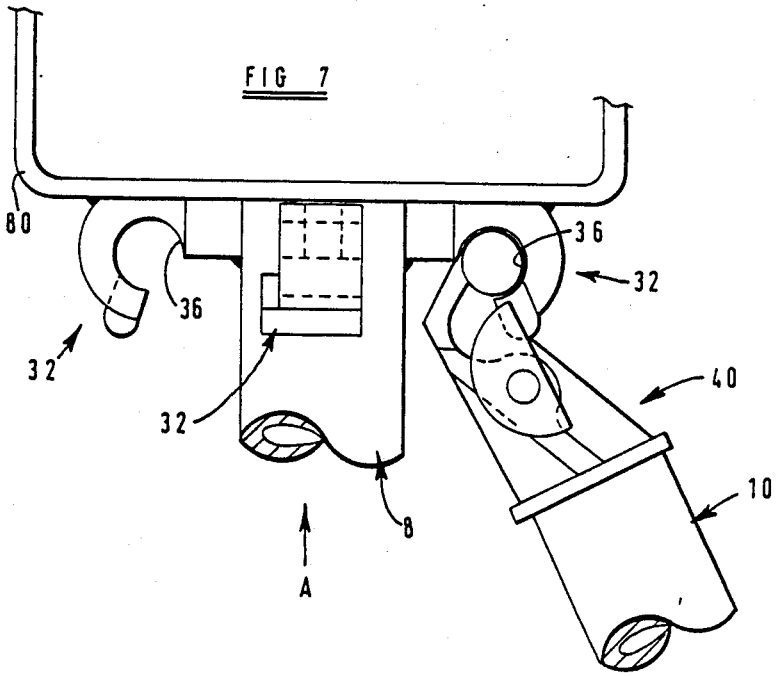
FIG. 7 is a view showing the application of the invention to a fork head connection.

FIG. 7 shows the application of this invention to a fork head connection, in which the receiving formations 32 are welded to the adjustable fork head. To ensure universal application of the fork head, four receiving formations are provided, being welded to the fork head at uniform spacing therearound (see FIG. 8).

Where aluminum support beams are used in the formwork carried by the scaffolding, brace receiving formations may be bolted to slots in the beams.

Figure 9:
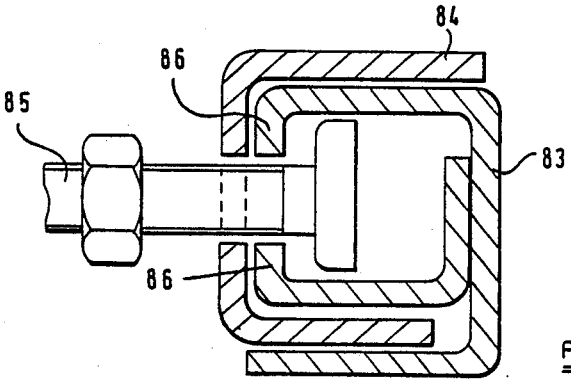
FIG. 9 is a cross-section through interlocking sections forming an adjustable brace member.

FIG. 9 shows in cross-section an extensible brace member comprising two slidably interfitting members 83 and 84, substituted for the elongate member 11. These interlocking members can have a varying overlap to give a required brace length between the mounting formations at the ends thereof.

A bolt 85 is located in a hole in a channel provided by the member 84, which can be tightened to engage inwardly-turned lips 86 to retain the elongate members 83 and 84 together in frictional engagement.

Figure 10:
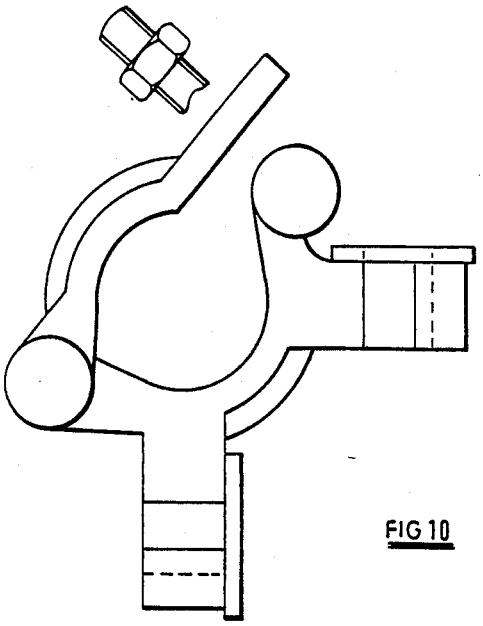
FIG. 10 is a side elevation of a clamp for brace connection to non-modular tube members of scaffolding of the kind specified.

FIG. 10 shows a connection member provided with two brace receiving formations at right angles to each other.

Additionally, the receiving formations may be attached to head or base jacks, or directly to any scaffolding upright.

I claim:

1. A scaffolding comprising:

an upright member having a supporting formation, a cross-member having a connection member releasably interengageable with said supporting formation to connect said members together, a socket provided in said connection member, and a brace which includes an elongate element having a central longitudinal axis, a connection portion, and a mounting formation, said connection portion connecting said mounting formation to said elongate element in fixed relationship with said elongate element, said mounting formation and said socket being of complementary male and female form respectively, said socket receiving said mounting formation releasably to secure said brace to said connection member, said mounting formation including an elongate structure having a longitudinal axis extending substantially perpendicular to said longitudinal axis of said elongate element, said connection portion being attached to said mounting formation at least at a region of said elongate structure intermediate in the length thereof, said socket defining an elongate receiving formation having end portions spaced in the elongate direction of said socket, an intermediate region between said end portions, and a gap leading laterally from said intermediate region to the exterior of said socket, said longitudinal axis of said elongate structure being aligned with said elongate direction of said socket, and said elongate structure being received in said receiving formation with said connection portion extending through said gap.

2. A scaffolding according to claim 1 wherein said upright member and said cross-member have longitudinal axes which lie in a common plane with said central longitudinal axis of said elongate element of said brace.

3. A scaffolding according to claim 2 wherein said receiving formation and said longitudinal axis of said elongate structure extend in a direction substantially perpendicular to said common plane.

4. A scaffolding according to claim 3 wherein first and second abutment surfaces are provided on said mounting formation spaced apart in the direction of said longitudinal axis of said elongate element, said longitudinal axis of said elongate element intersecting said abutment surfaces, first and second corresponding abutment surfaces being provided on said socket, respective said abutment surfaces and respective said corresponding abutment surfaces engaging each other so as to tranmit forces of tension and compression exerted along said longitudinal axis of said elongate element between said brace and said one connection means.

5. A scaffolding according to claim 4 wherein one of said end portions provides an entry to said receiving formation by way of which said mounting formation is insertable into said receiving space.

6. A scaffolding according to claim 1 wherein said connection portion is connected to said elongate structure along a substantial part of the length of said elongate structure.

7. A scaffolding according to claim 6 wherein said connection portion is connected to said elongate structure along substantially the whole of the length of said elongate structure.

8. A scaffolding according to claim 7 wherein said connection portion has a substantial dimension in the direction of said longitudinal axis of said elongate structure for the whole of its extent from said mounting formation to said elongate element.

9. A scaffolding according to claim 1 wherein said connection portion comprises a first end region attached to and adjacent said mounting formation, a middle region, and a second end region attached to and adjacent said elongate element, said middle region connecting said first and second end regions and being offset from the plane containing said longitudinal axes of said mounting formation and said elongate element, said first and second end regions of said connection portion being inclined to said plane containing said longitudinal axes of said mounting formation and said elongate element in opposite senses, and said middle region being spaced furthest from said plane containing said longitudinal axes of said mounting formation and said elongate element.

10. A scaffolding according to claim 4 wherein said first end region of said connection portion extends through said gap of said socket and said second end region extends away from said gap.

11. A scaffolding according to claim 10 said connection portion comprises a bent plate.

12. A scaffolding according to claim 1 wherein said elongate structure is substantially cylindrical and a region of said connection portion adjacent said mounting formation is attached to said elongate structure tangentially thereof.

13. A scaffolding according to claim 1 wherein said mounting formation has first and second ends spaced apart in the direction of said longitudinal axis of said elongate structure, and a support flange extends from one of said ends to said elongate element, said support flange being in a plane that is substantially parallel to said longitudinal axis of said elongate element and substantially perpendicular to the plane in which the longitudinal axes of said elongate structure and said elongate element lie.

14. A scaffolding according to claim 4 wherein at least one of said surfaces of said abutment surfaces and said corresponding abutment surfaces are part-circular.

15. A scaffolding according to claim 14 wherein said abutment surfaces and said corresponding abutment surfaces are part-cylindrical.

16. A scaffolding according to claim 1 wherein said elongate element has a cylindrical outer surface, said mounting formation is cylindrical, and said mounting formation lies substantially within a cylindrical envelope co-extensive with said outer surface of said elongate element.

* * * * *